US010024536B2

(12) United States Patent
Okamoto

(10) Patent No.: US 10,024,536 B2
(45) Date of Patent: Jul. 17, 2018

(54) COMBINED COMBUSTION DEVICE

(71) Applicant: Rinnai Corporation, Nagoya-shi, Aichi (JP)

(72) Inventor: Hideo Okamoto, Nagoya (JP)

(73) Assignee: Rinnai Corporation, Nagoya-shi, Aichi (JP)

( * ) Notice: Subject to any disclaimer, the term of this patent is extended or adjusted under 35 U.S.C. 154(b) by 63 days.

(21) Appl. No.: 14/421,466

(22) PCT Filed: Jul. 22, 2013

(86) PCT No.: PCT/JP2013/069765
§ 371 (c)(1),
(2) Date: Feb. 13, 2015

(87) PCT Pub. No.: WO2015/011754
PCT Pub. Date: Jan. 29, 2015

(65) Prior Publication Data
US 2016/0123585 A1 May 5, 2016

(51) Int. Cl.
*F23N 3/08* (2006.01)
*F23L 17/02* (2006.01)
(Continued)

(52) U.S. Cl.
CPC ..... *F23N 3/082* (2013.01); *F23L 5/02* (2013.01); *F23L 11/005* (2013.01); *F23L 17/00* (2013.01); *F23L 17/02* (2013.01); *F23N 3/08* (2013.01)

(58) Field of Classification Search
None
See application file for complete search history.

(56) References Cited

U.S. PATENT DOCUMENTS 8,235,707 B2 * 8/2012 Kim ..... F24H 9/2042 126/101
9,431,668 B2 * 8/2016 Shiosaki ..... H01M 8/04223
(Continued)

FOREIGN PATENT DOCUMENTS

EP 1178262 2/2002
EP 2639870 9/2013
(Continued)

OTHER PUBLICATIONS

Extended European Search Report for European Patent Application No. 13889791.3 dated Feb. 22, 2017.
(Continued)

*Primary Examiner* — David J Laux
(74) *Attorney, Agent, or Firm* — Amin, Turocy & Watson LLP

(57) ABSTRACT

A combined combustion device comprises: a plurality of combustion units (2) each having a burner (4) and an air supply fan (5); an exhaust collecting pipe (10) connecting the plurality of the combustion units (2) to each other; and a check valve (7) which opens by rotation of the air supply fan (5) and prevents backflow of combustion exhaust gas from the exhaust collecting pipe (10) into each of the combustion units (2), wherein when one or more of the combustion units (2) among the plurality of the combustion units (2) are in a combustion operation state and the other one or more of the combustion units (2) are continuously maintained in a non-combustion operation state for a predetermined reference stoppage time or longer, the air supply fans (5) of the other one or more of the combustion units (2) are rotated for a certain time.

11 Claims, 5 Drawing Sheets

(51) Int. Cl.

| | |
|---|---|
| ***F23L 11/00*** | (2006.01) |
| ***F23L 5/02*** | (2006.01) |
| ***F23L 17/00*** | (2006.01) |

(56) References Cited

U.S. PATENT DOCUMENTS

| | | | | |
|---|---|---|---|---|
| 9,478,813 | B2 * | 10/2016 | Yukimasa | F23L 17/005 |
| 2004/0185770 | A1 | 9/2004 | Soeholm et al. | |
| 2010/0330512 | A1 | 12/2010 | Kim | |
| 2012/0083194 | A1 * | 4/2012 | Hagensen | F23J 11/02 454/16 |
| 2014/0007821 | A1 * | 1/2014 | Villalobos | F23D 23/00 122/14.22 |

FOREIGN PATENT DOCUMENTS

| | | |
|---|---|---|
| JP | 64-1259 | 1/1989 |
| JP | 10-141525 | 5/1998 |
| JP | 11-311410 | 11/1999 |
| JP | 2001-132940 | 5/2001 |
| JP | 2002-013701 | 1/2002 |
| JP | 2002-349843 | 12/2002 |
| JP | 2004-251524 | 9/2004 |
| JP | 2012-149808 | 8/2012 |
| JP | 2013-164177 | 8/2013 |
| JP | 2013-164178 | 8/2013 |

OTHER PUBLICATIONS

International Search Report for International Patent Application No. PCT/JP2013/069765 dated Sep. 10, 2013.

Written Opinion for International Patent Application No. PCT/JP2013/069765 dated Sep. 10, 2013.

International Preliminary Report on Patentability for International Patent Application No. PCT/JP2013/069765 dated Feb. 4, 2016.

* cited by examiner

COMBINED COMBUSTION DEVICE

FIELD OF THE INVENTION

The present invention relates to a combined combustion device comprising a plurality of combustion units each having a burner and an air supply fan and an exhaust collecting pipe connecting the plurality of the combustion units to each other. Especially, the present invention relates to the combined combustion device capable of preventing backflow of combustion exhaust gas from the exhaust collecting pipe into each of the combustion units.

BACKGROUND ART

Conventionally, there has been known a combined combustion device provided with a plurality of combustion units each having a burner and an air supply fan, and the combustion units being arranged in parallel and connected to each other through one single exhaust collecting pipe. In this kind of the combined combustion device, an operation control is performed so as to adjust an operation number of the combustion units in accordance with load. Also, when combustion operation is performed, combustion exhaust gas from each of the combustion units is discharged out of the room through the exhaust collecting pipe by rotation of the air supply fan.

In the combined combustion device described above, since the necessary number of the combustion units is allowed to perform the combustion operation in accordance with the load, the combustion operation may be performed only in one or more of the combustion units among the plurality of the combustion units. Therefore, while the combustion exhaust gas from a combustion unit in a combustion operation state is discharged to the exhaust collecting pipe by the rotation of the air supply fan, the combustion exhaust gas may be flowed back from the combustion unit in the combustion operation state into the combustion unit in an non-combustion operation state through the exhaust collecting pipe, because the air supply fan is not rotated in the combustion unit in non-combustion operation state. As a result, a component such as the burner or the air supply fan in the combustion unit is likely to be corroded by acid combustion exhaust gas containing nitrogen and sulfur constituents.

In view of the above-described circumstances, it is considered that the air supply fan is continuously rotated not only in the combustion unit in the combustion operation state but also in the combustion unit in the non-combustion operation state, thereby preventing the back flow of the combustion exhaust gas through the exhaust collecting pipe. (For Example, Patent Document 1)

However, according to the combined combustion device described above, it is necessary to rotate the air supply fan of the combustion unit in the non-combustion operation state, so that there are problems that it is economically inefficient and an operation cost increases. Further, since the burner in the combustion unit in the non-combustion operation state is not burnt, an inside of the combustion unit is cooled by the rotation of the air supply fan, resulting in problems in that not only heat loss occurs but also water in a heat exchanger or a pipe provided in the combustion unit freeze in winter. Especially, since the combined combustion device is a large apparatus and is installed in a low temperature place such as a boiler room or a basement, the problem of the freezing described above can be easily occurred.

Prior Arts

[Patent Document 1] Japanese Unexamined Patent Publication No. 2001-132940 A

SUMMARY OF THE INVENTION

The present invention has been made to solve the problems described above, and an object of the present invention is to provide a combined combustion device capable of efficiently preventing backflow of combustion exhaust gas from a combustion unit in a combustion operation state into a combustion unit in a non-combustion operation state through an exhaust collecting pipe.

According to one aspect of the present invention, there is provided a combined combustion device comprising:

a plurality of combustion units each having a burner and an air supply fan;

an exhaust collecting pipe connecting the plurality of the combustion units to each other;

a check valve provided in each of the combustion units, which opens by rotation of the air supply fan and prevents backflow of combustion exhaust gas from the exhaust collecting pipe into each of the combustion units; and a controller for controlling operations of the plurality of the combustion units, wherein when one or more of the combustion units among the plurality of the combustion units are in a combustion operation state and the other one or more of the combustion units are continuously maintained in a non-combustion operation state for a predetermined reference stoppage time or longer, the controller rotates the air supply fans in the other one or more of the combustion units for a certain time.

According to another aspect of the present invention, there is provided a combined combustion device comprising:

a plurality of combustion units each having a burner, an air supply fan, and a backflow detector for detecting backflow of combustion exhaust gas;

an exhaust collecting pipe connecting the plurality of the combustion units to each other;

a check valve provided in each of the combustion units, which opens by rotation of the air supply fan and prevents the backflow of the combustion exhaust gas from the exhaust collecting pipe into each of the combustion units; and a controller for controlling operations of the plurality of the combustion units, wherein when one or more of the combustion units among the plurality of the combustion units are in a combustion operation state, the other one or more of the combustions units are continuously maintained in a non-combustion operation state, and the backflow detectors in the other one or more of the combustion units detect the backflow of the combustion exhaust gas, the controller rotates the air supply fans in the other one or more of the combustion units for a certain time.

According to the present invention, in the combined combustion device provided with the plurality of combustion units each having the burner and the air supply fan and the exhaust collecting pipe connecting the plurality of combustion units, it makes possible to efficiently prevent the combustion exhaust gas from flowing back into the combustion unit in the non-combustion operation state from the combustion unit in the combustion operation state through the exhaust collecting pipe.

Other objects, features and advantages of the present invention will become more fully understood from the detailed description given hereinbelow and the accompanying drawings which are given by way of illustration only, and thus are not to be considered as limiting the present invention.

PREFERRED MODE FOR CARRYING OUT THE INVENTION

Figure 1:
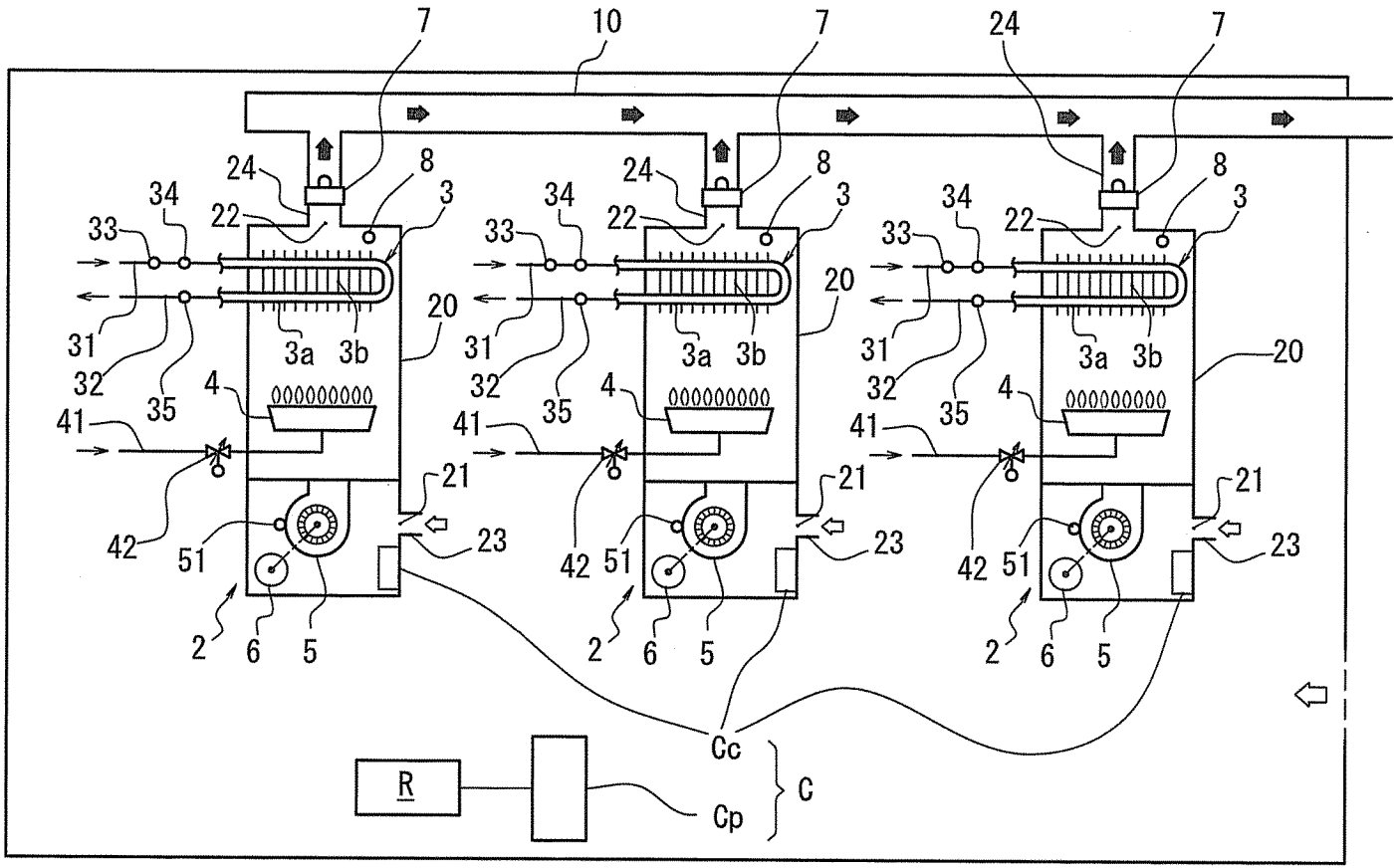
FIG. 1 is a schematic configuration diagram showing one example of a combined combustion device according to an embodiment of the present invention.

FIG. 1 is a schematic configuration diagram showing one example of a combined combustion device according to an embodiment of the present invention.

As shown in FIG. 1, the combined combustion device according to the present embodiment is, for example, a so-called forced exhaust type combined combustion device provided with three combustion units 2 as water heaters and an exhaust collecting pipe 10 connecting the combustion units 2 to each other.

Each of the combustion units 2 includes a can body 20 provided with an air supply port 21 through which combustion air is supplied and an exhaust port 22 through which combustion exhaust gas is discharged. In the can body 20, a heat exchanger 3 is provided in an upper part and a burner 4 is provided thereunder. Further, an air supply fan 5 is provided in a lower part of the can body 20. In the present embodiment, the combustion units 2 having a same combustion capacity are used, but alternatively the combustion units 2 having different combustion capacities may be used in accordance with the type of usage.

A gas circuit 41 is connected to the burner 4 and a gas proportional solenoid valve 42 is inserted to the gas circuit 41. An opening degree of the gas proportional solenoid valve 42 is controlled by a combustion amount signal from a controller C described later, whereby an amount of gas to the burner 4 is increased or decreased. An igniter and a thermocouple (not shown) are provided near the burner 4.

The heat exchanger 3 has a heat absorbing pipe 3*a* and a plurality of fins 3*b* transversely arranged to the heat absorbing pipe 3*a*. The heat absorbing pipe 3*a* is connected to a water supply pipe 31 at an inlet side and is connected to a hot-water supply pipe 32 at an outlet side. A flow sensor 33 and a supply water temperature thermistor 34 are provided in the water supply pipe 31 and a hot-water supply temperature thermistor 35 is provided in the hot-water supply pipe 32. Detected signals of an amount of water detected by the flow sensor 33, a supply water temperature detected by the supply water temperature thermistor 34 and a hot-water supply temperature detected by the hot-water supply temperature thermistor 35 are output to the controller C.

The air supply fan 5 is connected to a fan motor 6. The fan motor 6 is driven by applying thereto voltage corresponding to the combustion amount signal from the controller C. Also, a rotation speed of the air supply fan 5 and the combustion amount signal are in proportion to each other, and the rotation speed of the air supply fan 5 therefore increases as the combustion amount increases. With this, when a combustion operation is performed, the combustion air is supplied into the combustion unit 2 and the combustion exhaust gas generated by the combustion of the burner 4 is discharged out of the combustion unit 2. Further, the rotation speed of the air supply fan 5 is detected by a rotation sensor 51 and a detected signal of the rotation speed is output to the controller C.

A supply side passage 23 for supplying, as the combustion air, indoor air existing outside the combustion unit 2 into the can body 20 by the rotation of the air supply fan 5 is continuously provided with the air supply port 21 of the can body 20. Further, an exhaust side passage 24 for discharging the combustion exhaust gas existing inside the combustion unit 2 to the outdoors through the exhaust collecting pipe 10 by the rotation of the air supply fan 5 is continuously provided with the exhaust port 22 of the can body 20.

A downstream end of the exhaust side passage 24 is connected to the exhaust collecting pipe 10. Also, a check valve 7 which opens and closes the exhaust side passage 24 is provided in the exhaust side passage 24. With this, even when the combustion exhaust gas is discharged from the combustion unit 2 in the combustion operation state to the exhaust collecting pipe 10, the check valve 7 can prevent the combustion exhaust gas from flowing back into the combustion unit 2 in the non-combustion operation state.

Figure 2:
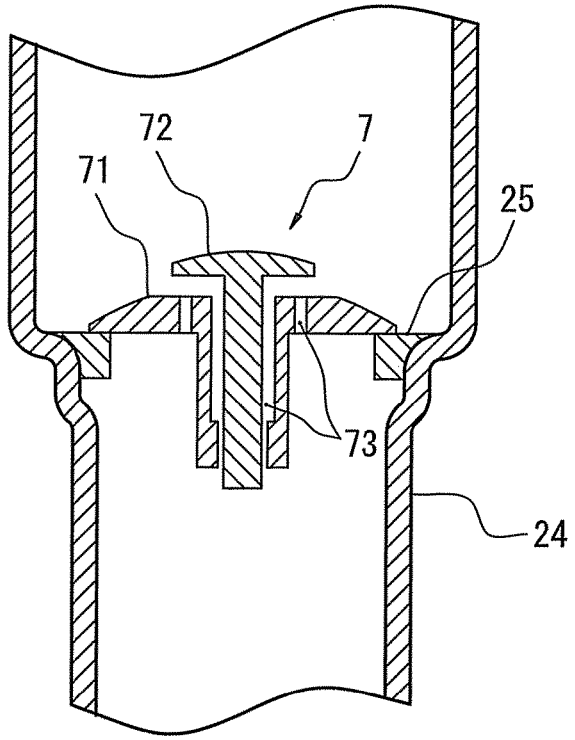
FIG. 2 is a schematic cross-sectional view showing one example of a check valve according to the embodiment of the present invention.

As shown in FIG. 2, the check valve 7 of a double-valve type, which includes a large-diameter first valve 71 having through-holes 73,73 on the central part and outer periphery thereof and a small-diameter second valve 72 inserted into the through-hole 73 located on the central part, is used in the present embodiment. Specifically, when the air supply fan 5 does not rotate, an lower surface of the first valve 71 abuts on an engagement portion 25 provided in the exhaust side passage 24 and a lower surface of the second valve 72 abuts on an upper surface of the first valve 71, respectively, due to their own weight, so that the exhaust side passage 24 is closed. Also, when the rotation speed of the air supply fan 5 becomes a predetermined low rotation speed or higher, the first valve 71 is in a closed state but the second valve 72 leaves from the first valve 71 to open. As a result, a narrow gap is formed between the first valve 71 and the second valve 72, and the exhaust side passage 24 is opened through the through-holes 73, 73. Further, when the rotation speed of the air supply fan 5 becomes a predetermined high rotation speed or higher, the first valve 71 leaves from the engagement portion 25 to open. As a result, a wide gap is formed between the first valve 71 and the exhaust side passage 24, and the exhaust side passage 24 is opened.

Referring back to FIG. 1, a CO sensor 8 which detects a carbon monoxide concentration inside the combustion unit 2 as a backflow detector for detecting the backflow of the combustion exhaust gas is arranged near the exhaust port 22 in the upper part of the can body 20. A detected signal of the carbon monoxide concentration detected by the CO sensor 8 is continuously output to the controller C. As the backflow detecting means, a temperature sensor for detecting temperature inside the combustion unit 2 or pressure sensors for detecting pressures inside the exhaust collecting pipe 10 and the combustion unit 2 respectively may be used. However, since the CO sensor is excellent in response, as compared to the temperature sensor or the pressure sensor, it makes possible to quickly detect the backflow of the combustion exhaust gas.

The exhaust collecting pipe 10 branches to connect to the exhaust side passages 24 of each of the combustion units 2, and communicates with the outdoors on a downstream end thereof. With this, the combustion exhaust gas generated from the combustion units 2 during the combustion operation is discharged to the outdoors through the exhaust collecting pipe 10.

Next, details of preventing the backflow of the combustion exhaust gas in the above combined combustion device will be described with examples.

EXAMPLE 1

A combined combustion device according to the present example, as a controller C, includes control units Cc which control operations of each of the combustion units 2 and a connecting control unit Cp which controls operations of the control units Cc. Although not shown, each of the control units Cc includes a combustion operation control section for controlling a combustion operation of the combustion unit 2 and a fan control section for controlling an operation of the air supply fan 5. The connecting control unit Cp includes an operation control section for determining a number of the combustion units 2 requiring to perform the combustion operation in accordance with the load and giving an instruction of the combustion operation to each of the control units Cc, an intermittent blow operation control section for giving an instruction of intermittent blow operation to the combustion unit 2 in the non-combustion operation state, a memory in which a program for performing these operations are stored, and a timer. Further, the control unit Cc in each of the combustion units is connected to the igniter, the thermocouple, the gas proportional solenoid valve 42, the flow sensor 33, the supply water temperature thermistor 34, the hot-water supply temperature thermistor 35, the fan motor 6, the rotation sensor 51, and the CO sensor 8, via connected lines, and those signals are output to the connecting control unit Cp. The connecting control unit Cp is electrically connected to the control units Cc and a remote controller R provided in a house.

The operation control section of the connecting control unit Cp determines the number of the combustion units 2 allowed to perform the combustion operation in accordance with the load, and calculates a necessary combustion amount of the burner 4 using a predetermined arithmetic expression on the basis of the amount of water detected by the flow sensor 33, the supply water temperature detected by the supply water temperature thermistor 34, and the hot water supply temperature detected by the hot water supply temperature thermistor 35. Also, the combustion operation control section of the control unit Cc sets a target rotation speed of the air supply fan 5 in order to supply an appropriate amount of the combustion air corresponding to the calculated necessary combustion amount to the burner 4 of the combustion unit 2 on the basis of the instruction from the operation control section of the connecting control unit Cp during the combustion of the burner 4. Further, the fan motor 6 is subjected to feedback control in such a manner that the rotation speed detected by the rotation sensor 51 of the air supply fan 5 coincides with the target rotation speed. Moreover, in order to supply gas in an amount corresponding to the amount of the combustion air supplied to the burner 4 by the air supply fan 5, an energization amount to the gas proportional solenoid valve 42 is determined according to the rotation speed detected by the rotation sensor 51, and the gas proportional solenoid valve 42 is energized and controlled according to the determined energization amount. With this, the gas in the amount corresponding to the amount of the combustion air supplied to the burner 4 is supplied to the burner 4. Also, the carbon monoxide concentration detected by the CO sensor 8 in the combustion unit 2 in the combustion operation state is continuously monitored. Further, when the carbon monoxide concentration inside at least one of the combustion units 2 becomes a predetermined reference combustion operation concentration or higher, the connecting control unit Cp determines combustion failure, notifies an abnormality, and stops the supply of the gas to the burner 4 and the combustion operation.

In a case where the combustion operation is not performed in at least one of the combustion units 2 by the combustion operation control section of the control unit Cc, the intermittent blow operation control section of the connecting control unit Cp starts the timer to measure time during which the combustion unit 2 is in the non-combustion operation state. When the combustion unit 2 is continuously maintained in the non-combustion operation state for a predetermined reference stoppage time or longer, the intermittent blow operation control section of the connecting control unit Cp gives the instruction of the intermittent blow operation of the air supply fan 5 to the control unit Cc, and the fan control section of the control unit Cc rotates the air supply fan 5 of the combustion unit 2 in the non-combustion operation state at a minimum rotation speed for a certain time. In the Meantime, a rotation time of the air supply fan 5 during the intermittent blow operation is appropriately determined taking an inner volume of the combustion unit 2 and an air supply capability of the air supply fan 5 into consideration. Also, in a case where the carbon monoxide concentration detected by the CO sensor 8 of the combustion unit 2 in the non-combustion operation state becomes a predetermined reference non-combustion operation concentration or higher, the air supply fan 5 is, same as the above, rotated at the minimum rotation speed for a given time, even when the combustion unit 2 is maintained in the non-combustion operation for less than the reference stoppage time. Further, the reference stoppage time for determining whether the combustion unit 2 is maintained in the non-combustion operation state for the predetermined time is reduced. In a case where the carbon monoxide concentration detected by the CO sensor 8 becomes the reference non-combustion operation concentration or higher again after the reference stoppage time is reduced, the connecting control unit Cp determines that sealing property of the check valve 7 is deteriorated, and then, the abnormality is notified and the supply of the gas to the burner 4 and the combustion operation are stopped.

Figure 3:
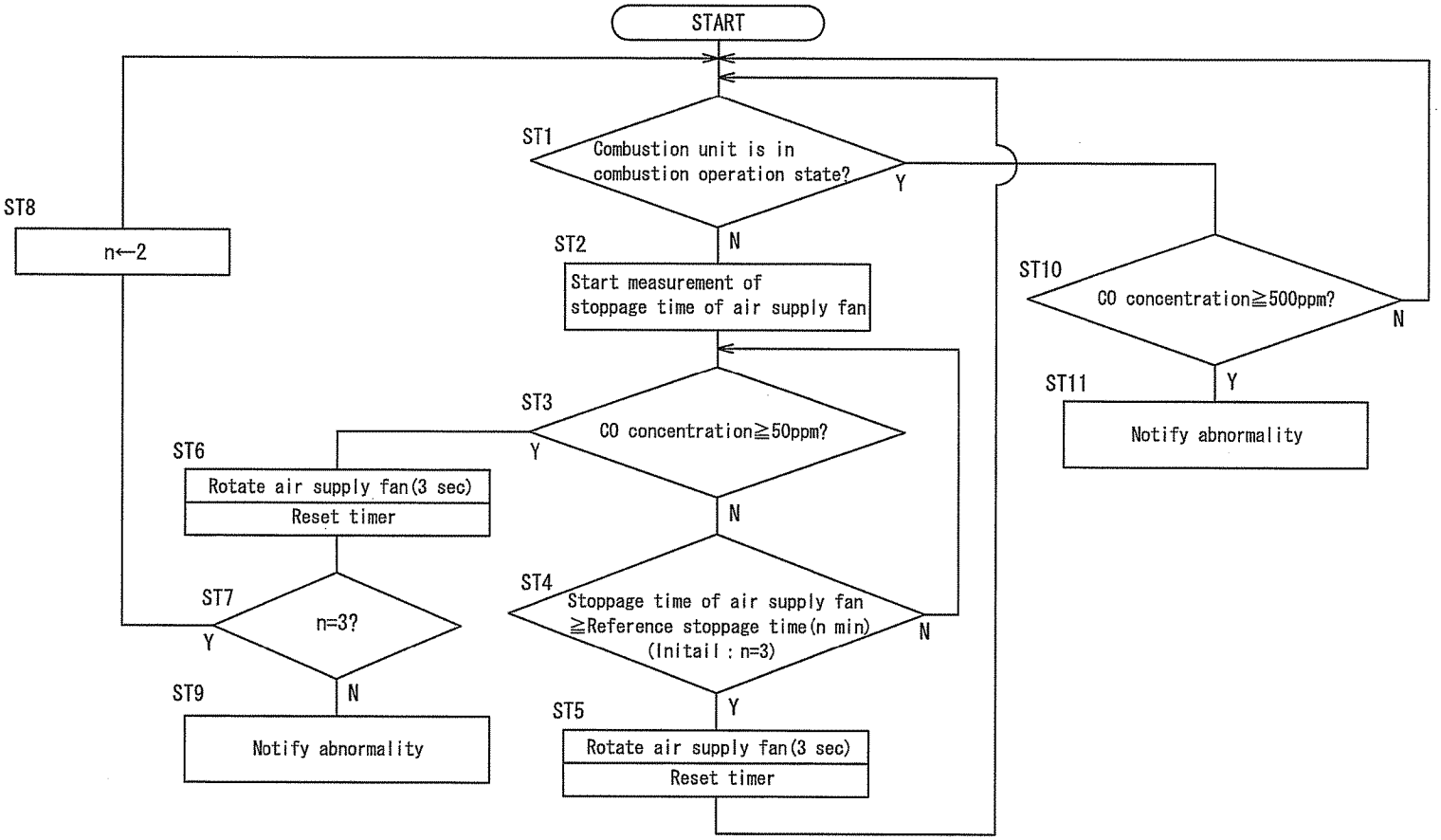
FIG. 3 is a control flow chart showing an operation of a combined combustion device according to Example 1 of the present invention.

Next, in the combined combustion device according to the present example, control steps for preventing the backflow of the combustion exhaust gas will be described with reference to FIG. 3.

When an operation of a system is started and the connecting control unit Cp determines the number of the combustion units 2 requiring to perform the combustion operation, the control unit Cc to which the instruction of the combustion operation is given starts the combustion operation of the combustion unit 2, and the connecting control unit Cp determines whether each of the control units 2 is performing the combustion operation (Step ST1). Then, in a case where only one or more of the combustion units 2 among the plurality of the combustion units 2 are in the combustion operation state and the other one or more of the combustion units 2 are maintained in the non-combustion operation state, the intermittent blow operation control section of the connecting control unit Cp starts the timer to measure the stoppage time of the air supply fan 5 of the combustion unit 2 in the non-combustion operation state (Step ST2). Specifically, since it is normally not necessary to rotate the air supply fan 5 when the combustion unit 2 is in the non-combustion operation state, duration time of the non-combustion operation state can be measured by measuring the stoppage time of the air supply fan 5. Meanwhile, the duration time of the non-combustion operation state may be measured by a combustion time of the burner 4 detected by the thermocouple or the like.

Then, the carbon monoxide concentration detected by the CO sensor 8 is monitored, and it is confirmed whether the carbon monoxide concentration inside the combustion unit 2 in the non-combustion operation state is the predetermined reference non-combustion operation concentration (for example, 50 ppm) or higher (Step ST3). With this, it makes possible to determine whether the combustion exhaust gas has been flowed back into the combustion unit 2 in the non-combustion operation state through the exhaust collecting pipe 10, due to the degradation of the sealing property of the checking valve 7.

When the carbon monoxide concentration inside the combustion unit 2 is less than the reference non-combustion operation concentration (No in Step ST3), the intermittent blow operation control section determines whether the stoppage time of the air supply fan 5 of the combustion unit 2 in the non-combustion operation state is initial reference stoppage time (for example, 3 minutes) or longer (Step ST4).

When the air supply fan 5 stops for the initial reference stoppage time or longer (Yes in Step ST4), the air supply fan 5 of the combustion unit 2 in the non-combustion operation state is rotated at the minimum rotation speed for the certain time (for example, 3 seconds), and the timer is reset (Step ST5). With this, the second valve 72 of the check valve 7 provided in the exhaust side passage 24 opens and air inside the combustion unit 2 is discharged to the exhaust collecting pipe 10. Accordingly, even if the combustion exhaust gas having the carbon monoxide concentration less than the reference non-combustion operation concentration flows back into the combustion unit 2 in the non-combustion operation state, it makes possible to discharge the combustion exhaust gas out of the combustion unit 2 quickly. Also, since the check valve 7 has a double-valve structure and the second valve 72 can open to allow the exhaust side passage 24 to be open only by rotating the air supply fan 5 at the low rotation speed, it makes possible to efficiently discharge the combustion exhaust gas having flowed back thereto. Further, since the air inside the combustion unit 2 can be discharged to the exhaust side passage 24 at every reference stoppage time even when the sealing property of the check valve 7 is deteriorated, it makes possible to reduce the backflow of the combustion exhaust gas. Moreover, since the air supply fan 5 is only rotated for a short period of time, it makes possible to prevent not only the backflow of the combustion exhaust gas efficiently compared to a case where the air supply fan 5 is continuously rotated but also freezing inside the combustion unit 2 in the non-combustion operation state in winter.

After the rotation of the air supply fan 5 ends, the determination of the non-combustion operation state, the measurement of the stoppage time of the air supply fan 5, and the determination of the carbon monoxide concentration inside the combustion units 2 are repeated (Steps ST1 to ST3).

In spite of the non-combustion operation state of the combustion unit 2, when the carbon monoxide concentration inside the combustion unit 2 becomes the predetermined reference non-combustion operation concentration or higher (Yes in Step ST3), the air supply fan 5 is rotated for the given time (for example, 3 seconds) and the timer is reset even when the stoppage time of the air supply fan 5 under the measurement is less than the initial reference stoppage time (Step ST6) With this, increase of the combustion exhaust gas having flowed back into the combustion unit 2 can be reduced.

Then, it is determined whether the reference stoppage time is an initial value (Step ST7). When the reference stoppage time is the initial value (Yes in Step ST7), the reference stoppage time for determining the non-combustion operation state of the combustion unit 2 is reduced (for example, 2 minutes) (Step ST8). Specifically, since the air supply fan 5 in the combustion unit 2 in the non-combustion operation state is not rotated normally, the exhaust side passage 24 is closed by the check valve 7 and the backflow of the combustion exhaust gas from the exhaust collecting pipe 10 is prevented. In spite of that, as a reason of the carbon monoxide in a certain concentration or higher detected inside the combustion unit 2 in the non-combustion operation state, it is conceivable that the check valve 7 is jammed or a foreign matter is bitten in the check valve 7, whereby the combustion exhaust gas is likely to flow back into the combustion unit 2. Accordingly, it makes possible to discharge the combustion exhaust gas having flowed back into the combustion unit 2 quickly, by reducing the reference stoppage time for determining whether the combustion unit 2 is in the non-combustion state.

After the reference stoppage time is reduced, the determination of the non-combustion operation state, the measurement of the stoppage time of the air supply fan 5, and the determination of the carbon monoxide concentration inside the combustion units 2 are repeated (Step ST1 to ST3). When the carbon monoxide concentration inside the combustion unit 2 in the non-combustion operation state again becomes the reference non-combustion operation concentration or higher (Yes in Step ST3), the air supply fan 5 is rotated for the given time in the same manner as described above (Step ST6). At this point, since the reference stoppage time has been already reduced (No in Step ST7), it is conceivable that the backflow of the combustion exhaust gas cannot be prevented merely by intermittently rotating the air supply fan 5 at a short time interval. Accordingly, the connecting control unit Cp notifies the abnormality caused by the backflow of the combustion exhaust gas through the remote controller R or the like, and the combustion operation is stopped (Step ST9).

The detection of the carbon monoxide concentration is continued while the combustion unit 2 is in the non-combustion operation state. When the number of the combustion units 2 requiring to perform the combustion operation is increased due to a change in the required load and the combustion operation is started in the combustion unit 2 in the non-combustion operation state (Yes in Step ST1), it is determined whether the carbon monoxide concentration inside the combustion unit 2 output from the CO sensor 8 is the reference combustion operation concentration (for example, 500 ppm) or higher (Step ST10). The reference combustion operation concentration is set higher than the reference non-combustion operation concentration because the carbon monoxide concentration inside the combustion unit 2 becomes higher than that inside the combustion unit 2 in the non-combustion operation state, by the combustion of the gas in the burner 4 in the combustion operation.

While the combustion unit 2 performs the combustion operation, the carbon monoxide concentration is monitored. When the carbon monoxide concentration during the combustion operation becomes the reference combustion operation concentration or higher (Yes in Step ST10), there is a high possibility that combustion failure occurs in the combustion unit 2, and accordingly the abnormality is notified through the remote controller R or the like, and the combustion operation is stopped, in the same manner as described above (Step ST11). With this, it makes possible to quickly prevent the combustion failure during the combustion operation.

EXAMPLE 2

A combined combustion device according to the present example, as a controller C, includes control units Cc which control operations of each of the combustion units 2 and a connecting control unit Cp which controls operations of the control units Cc in the same manner as in Example 1. Also, the control unit Cc according to the present example, as its functional means, includes a combustion operation control section and a fan control section in the same manner as in Example 1. Further, the connecting control unit Cp according to the present example, as its functional means, includes an operation control section, a memory, and a timer, in the same manner as in Example 1, but includes a blow operation control section for giving an instruction of blow operation to the combustion unit 2 in the non-combustion operation state instead of the intermittent blow operation control section.

Specifically, when the carbon monoxide concentration detected by the CO sensor 8 provided in the combustion unit 2 in the non-combustion operation state becomes a predetermined reference non-combustion operation concentration or higher, the blow operation control section of the connecting control unit Cp gives the instruction of the blow operation of the air supply fan 5 to the control unit Cc, and the fan control section of the control unit Cc rotates the air supply fan 5 of the combustion unit 2 in the non-combustion operation state at a minimum rotation speed for a certain time. Namely, the blow operation control section differs from the intermittent blow operation control section of the Example 1 in that it includes a control arrangement for performing the blow operation based on the carbon monoxide concentration without measuring time during which the combustion unit 2 is in the non-combustion operation state. In a case where the carbon monoxide concentration detected by the CO sensor 8 becomes the reference non-combustion operation concentration or higher after the rotation of the air supply fan 5 based on the carbon monoxide concentration is carried out multiple times, the connecting control unit Cp determines that sealing property of the check valve 7 is deteriorated and notifies an abnormality, and then, the supply of the gas to the burner 4 and the combustion operation are stopped.

Figure 4:
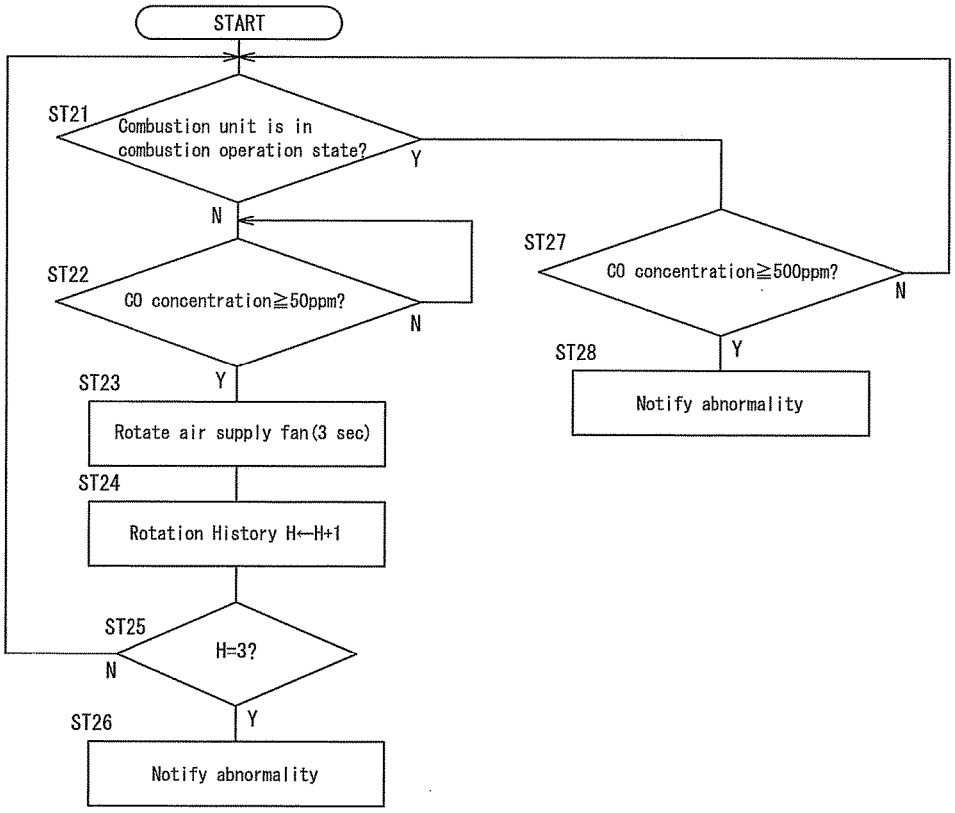
FIG. 4 is a control flow chart showing an operation of a combined combustion device according to Example 2 of the present invention.

Next, in the combined combustion device according to the present example, control steps for preventing the backflow will be described with reference to FIG. 4.

When an operation of a system is started and the connecting control unit Cp determines a number of the combustion units 2 requiring to perform the combustion operation, the control unit Cc to which the instruction of the combustion operation is given starts the combustion operation of the combustion unit 2, and the connecting control unit Cp determines whether each of the control units 2 is performing the combustion operation (Step ST21). Then, in a case where only one or more of the combustion units 2 among the plurality of the combustion unit 2 are in the combustion operation state and the other one or more of the combustion units 2 are maintained in the non-combustion operation state, the blow operation control section of the connecting control unit Cp monitors the carbon monoxide concentration output from the CO sensor 8 and determines whether the carbon monoxide concentration inside the combustion unit 2 in the non-combustion operation state is the predetermined reference non-combustion operation concentration (for example, 50 ppm) or higher (Step ST22). With this, it makes possible to determine whether the combustion exhaust gas has been flowed back into the combustion unit 2 in the non-combustion operation state through the exhaust collecting pipe 10, due to the degradation of the sealing property of the checking valve 7.

In spite of the non-combustion operation state of the combustion unit 2, when the carbon monoxide concentration inside the combustion unit 2 becomes the predetermined reference non-combustion operation concentration or higher (Yes in Step ST22), the air supply fan 5 of the combustion unit 2 in the non-combustion operation state is rotated at the minimum rotation speed for the certain time (for example, 3 seconds). With this, the second valve 72 of the check valve 7 provided in the exhaust side passage 24 opens and air inside the combustion unit 2 is discharged to the exhaust collecting pipe 10. Accordingly, even if the combustion exhaust gas including the carbon monoxide equal to or higher than a certain concentration flows back into the combustion unit 2 in the non-combustion operation state due to the degradation of the sealing property of the checking valve 7, it makes possible to discharge the combustion exhaust gas out of the combustion unit 2 quickly. Also, since the check valve 7 has a double-valve structure and the second valve 72 can open to allow the exhaust side passage 24 to be open only by rotating the air supply fan 5 at the low rotation speed, it makes possible to efficiently discharge the combustion exhaust gas having flowed back thereto. Further, since the air supply fan 5 is only rotated for a short period of time, it makes possible to prevent not only the backflow of the combustion exhaust gas efficiently compared to a case where the air supply fan 5 is continuously rotated but also freezing inside the combustion unit 2 in the non-combustion operation state in winter.

After the air supply fan 5 rotates for the certain time, the connecting control unit Cp records a rotation history H of the air supply fan 5 as H+1 (Step ST24). Then, the connecting control unit Cp determines whether the rotation history H is a predetermined set number (for example, 3 times) (Step ST25).

After the determination of the backflow of the combustion exhaust gas based on the carbon monoxide concentration and the rotation of the air supply fan 5 are repeated, when the number of the rotation history H becomes the predetermined set number (for example, 3 times) (Yes in Step ST25), the abnormality caused by the backflow of the combustion exhaust gas is notified through the remote controller R or the like, and the combustion operation is stopped (Step ST26). Specifically, since the air supply fan 5 of the combustion unit 2 in the non-combustion operation state is not rotated normally, the exhaust side passage 24 is closed by the check valve 7 and the backflow of the combustion exhaust gas from the exhaust collecting pipe 10 is prevented. Further, when the backflow of the combustion exhaust gas due to the degradation of the sealing property of the check valve 7 is detected by the CO sensor 8, the combustion exhaust gas is discharged by rotating of the air supply fan 5. In spite of that, as a reason that the carbon monoxide in a certain concentration or higher inside the combustion unit 2 in the non-combustion operation state is detected multiple times, it is conceivable that the sealing property of the check valve 7 is deteriorated, whereby the combustion exhaust gas is likely to flow back into the combustion unit 2 in the non-combustion operation state. Accordingly, a user can be allowed to quickly perceive the deterioration of the sealing property of the check valve 7 by notifying the abnormality.

Control steps (Steps ST27 to ST28) when the combustion unit 2 is in the combustion operation state are same as those (Steps ST10 to ST11) of the Example 1.

(Other Embodiments)

Figure 5:
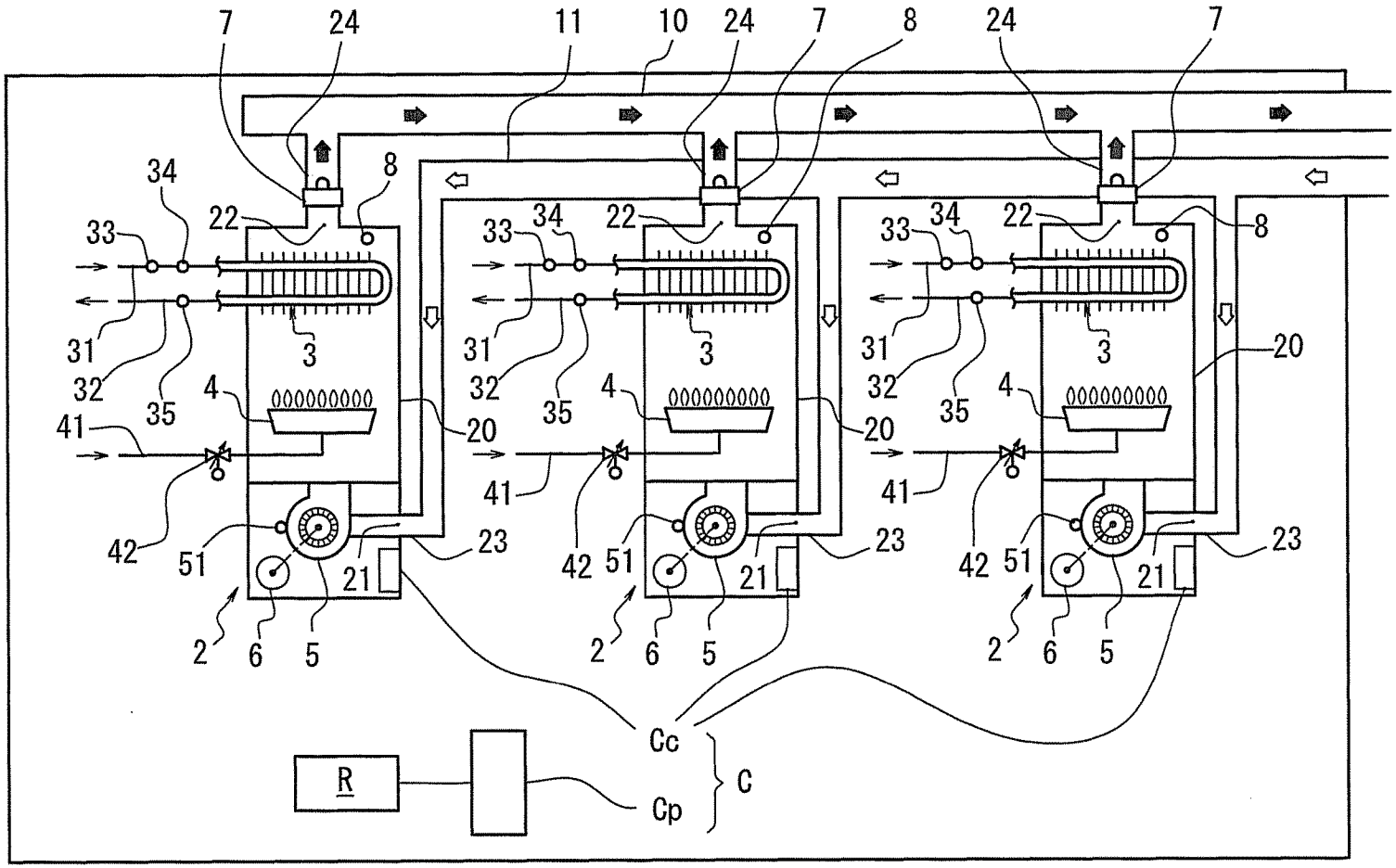
FIG. 5 is a schematic configuration diagram showing one example of a combined combustion device according to another embodiment of the present invention.

(1) In the embodiment described above, the forced exhaust type combined combustion device provided with the exhaust collecting pipe 10 is described, but alternatively the present invention can be applied to a forced draft balanced flue type combustion device comprising a plurality of combustion units connected to each other through an exhaust collecting pipe 10 and an intake collecting pipe 11 as shown in FIG. 5. In the forced draft balanced flue type combustion device, combustion air is supplied from the outdoors to the combustion unit 2 through the intake collecting pipe 11. In the forced draft balanced flue type combustion device, control steps when the intermittent blow operation or the blow operation described above is performed are same as those in the forced exhaust type combined combustion device.

(2) In the embodiment described above, the air supply fan 5 is rotated at the minimum rotation speed in order to prevent the backflow of the combustion exhaust gas, but alternatively the air supply fan may be rotated at a higher rotation speed than the minimum rotation speed in order to reduce a rotation time of the air supply fan 5.

(3) In the embodiment above, the check valve 7 is provided in the exhaust side passage 24, but alternatively the check valve 7 may be provided in the supply side passage 23.

(4) In the embodiment above, the check valve 7 of the double-valve type is used, but alternatively a check valve of a single-valve type maybe used. Further, in a case where the check valve of the double-valve type is used, the check valve 7 in which two or more springs having different elasticities are housed may be used.

As described in detail, the present invention is summarized as follows.

According to one aspect of the present invention, there is provided a combined combustion device comprising:

a plurality of combustion units each having a burner and an air supply fan;

an exhaust collecting pipe connecting the plurality of the combustion units to each other;

a check valve provided in each of the combustion units, which opens by rotation of the air supply fan and prevents backflow of combustion exhaust gas from the exhaust collecting pipe into each of the combustion units; and a controller for controlling operations of the plurality of the combustion units, wherein when one or more of the combustion units among the plurality of the combustion units are in a combustion operation state and the other one or more of the combustion units are continuously maintained in a non-combustion operation state for a predetermined reference stoppage time or longer, the controller rotates the air supply fans in the other one or more of the combustion units for a certain time.

According to the combined combustion device described above, since each of the combustion units has the check valve opening by the rotation of the air supply fan, even when the combustion exhaust gas is discharged from the combustion unit in the combustion operation state to the exhaust collecting pipe, it makes possible to prevent the combustion exhaust gas from flowing back into the combustion unit in the non-combustion operation state. On the other hand, in a case where the check valve is provided, the sealing property of the check valve is likely to be deteriorated by jamming of the check valve or catching of a foreign matter in the check valve. However, according to the combined combustion device described above, when at least one of the combustion units is in the non-combustion operation state for the predetermined reference stoppage time or longer, the air supply fan is rotated for the certain time, and accordingly even when the sealing property is deteriorated, it makes possible to discharge the air inside the combustion unit to the exhaust collecting pipe, whereby the backflow of the combustion exhaust gas can be reduced. Also, when the duration time of the non-combustion operation state becomes the predetermined reference stoppage time or longer, the air supply fan is rotated, and accordingly it makes possible to discharge the combustion exhaust gas to the exhaust collecting pipe before the combustion exhaust gas flowing back into the combustion unit increases. Further, since the air supply fans in the other one or more of the combustion units in the non-combustion operation state are intermittently rotated, it makes possible to prevent not only the backflow of the combustion exhaust gas efficiently compared to a case where the air supply fans are continuously rotated but also freezing inside the combustion units in the non-combustion operation state in winter.

Preferably, in the combined combustion device described above, the check valve may have a first valve opening by rotating the air supply fan at a high rotation speed and a second valve opening by rotating the air supply fan at a low rotation speed.

According to the combined combustion device described above, since the check valve includes the second valve opening by rotating the air supply fan at the low rotation speed, it makes possible to prevent the backflow of the combustion exhaust gas efficiently. Further, since the check valve includes the first valve opening by rotating the air supply fan at the high rotation speed, discharge of the combustion exhaust gas during the combustion operation is not disturbed.

Preferably, the combined combustion device described above further comprises a backflow detector for detecting the backflow of the combustion exhaust gas in each of the combustion units, wherein when the backflow detectors detect the backflow of the combustion exhaust gas, the controller rotates the air supply fans in the other one or more of the combustion units for a given time even when the other one or more of the combustion units are maintained in the non-combustion operation state for less than the reference stoppage time.

If each of the combustion units includes the backflow detector for detecting the backflow of the combustion exhaust gas, it is possible to detect directly that a certain amount of the combustion exhaust gas is flowed back into the combustion unit. Also, if the backflow detector detects the backflow of the combustion exhaust gas even after the air supply fan in the combustion unit in the non-combustion operation state is rotated at every certain time, there is a possibility that the sealing property of the check valve is deteriorated by jamming of the check valve or the like, whereby the amount of the combustion exhaust gas flowing back into the combustion unit is increased. Accordingly, by rotating the air supply fans in the other one or more of the combustion units with possibilities of the backflow of the combustion exhaust gas, even when the duration time of the non-combustion operation state is less than the reference stoppage time, it makes possible to certainly discharge the combustion exhaust gas having flowed back into the combustion units.

Preferably, the combined combustion device described above further comprises a backflow detector for detecting the backflow of the combustion exhaust gas in each of the combustion units, wherein when the backflow detector detects the backflow of the combustion exhaust gas, the controller reduces the reference stoppage time.

If each of the combustion units includes the backflow detector for detecting the backflow of the combustion exhaust gas, it is possible to detect directly that a certain amount of the combustion exhaust gas is flowed back into the combustion unit. Also, if the backflow detector detects the backflow of the combustion exhaust gas even after the air supply fan in the combustion unit in the non-combustion operation state is rotated at every certain time, there is a possibility that the sealing property of the check valve is deteriorated by jamming of the check valve or the like, whereby the amount of the combustion exhaust gas flowing back into the combustion unit is increased. Accordingly, by reducing the reference stoppage time for determining whether the combustion unit is in the non-combustion operation state, it makes possible to discharge the combustion exhaust gas having flowed back into the combustion unit 2 quickly.

Preferably, in the combined combustion device described above, when the backflow detector detects the backflow of the combustion exhaust gas after the reference stoppage time is reduced, the controller may notify an abnormality.

In a case where the backflow detector detects the backflow of the combustion exhaust gas even after the reference stoppage time is reduced to increase a frequency of the rotation of the air supply fan, there is a possibility that the degradation of the sealing property of the check valve due to jamming of the check valve or the like may not be repaired merely by the rotation of the air supply fan. Therefore, according to the combined combustion device described above, a user can quickly perceive the abnormality due to the backflow of the combustion exhaust gas.

According to another aspect of the present invention, there is provided a combined combustion device comprising:

a plurality of combustion units each having a burner, an air supply fan, and a backflow detector for detecting backflow of combustion exhaust gas;

an exhaust collecting pipe connecting the plurality of the combustion units to each other;

a check valve provided in each of the combustion units, which opens by rotation of the air supply fan and prevents the backflow of the combustion exhaust gas from the exhaust collecting pipe into each of the combustion units; and a controller for controlling operations of the plurality of the combustion units, wherein when one or more of the combustion units among the plurality of the combustion units are in a combustion operation state, the other one or more of the combustions units are continuously maintained in a non-combustion operation state, and the backflow detectors in the other one or more of the combustion units detect the backflow of the combustion exhaust gas, the controller rotates the air supply fans in the other one or more of the combustion units for a certain time.

According to the combined combustion device described above, since each of the combustion unit has the check valve opening by rotation of the air supply fan, even when the combustion exhaust gas is discharged from the combustion unit in the combustion operation state to the exhaust collecting pipe, it makes possible to prevent the combustion exhaust gas from flowing back into the combustion unit in the non-combustion operation state. On the other hand, in a case where the check valve is provided, the sealing property of the check valve is likely to be deteriorated by jamming of the check valve or catching of a foreign matter in the check valve. However, according to the combined combustion device described above, since each of the combustion units has the backflow detector and the air supply fan is rotated for the certain time when the backflow detector detects the backflow of the combustion exhaust gas in the combustion unit in the non-combustion operation state, it makes possible to discharge the air inside the combustion unit to the exhaust collecting pipe even when the sealing property of the check valve is deteriorated, whereby the backflow of the combustion exhaust gas can be reduced. Further, since the air supply fan is rotated for the certain time only when the backflow detector detects the back flow, it makes possible to prevent not only the backflow of the combustion exhaust gas efficiently compared to a case where the air supply fan is continuously rotated but also freezing inside the combustion unit in the non-combustion operation state in winter.

Preferably, in the combined combustion device described above, the check valve may have a first valve opening by rotating the air supply fan at a high rotation speed and a second valve opening by rotating the air supply fan at a low rotation speed.

According to the combined combustion device described above, since the check valve includes the second valve opening by rotating the air supply fan at the low rotation speed, it makes possible to prevent the backflow of the combustion exhaust gas efficiently. Further, since the check valve includes the first valve opening by rotating the air supply fan at the high rotation speed, discharge of the combustion exhaust gas during the combustion operation is not disturbed.

Preferably, in the combined combustion device described above, the backflow detector may include a CO sensor.

As the CO sensor is more excellent in response than a temperature sensor or a pressure sensor, it makes possible to detect the backflow of the combustion exhaust gas quickly.

Preferably, in the combined combustion device described above, when the backflow detectors of the other one or more of the combustion units detect the backflow of the combustion exhaust gas after the air supply fans of the other one or more of the combustion units are rotated for the certain time, the controller may notify an abnormality.

In a case where the backflow detector detects the backflow of the combustion exhaust gas even after the air inside the combustion unit is discharged by rotating the air supply fan, there is a possibility that the sealing property of the check valve deteriorated by jamming of the check valve or the like may not be repaired merely by the rotation of the air supply fan. Therefore, according to the combined combustion device described above, a user can quickly perceive the abnormality due to the backflow of the combustion exhaust gas.

Although the present invention has been described hereinabove with reference to exemplary embodiments and examples, the present invention is not limited thereto. The configuration and details of the present invention are open to various modifications within the scope of the present invention that would be clear to those skilled in the art.

INDUSTRIAL APPLICABILITY

According to the present invention, there is provided a combined combustion device capable of efficiently preventing backflow of combustion exhaust gas from a combustion unit in a combustion operation state to a combustion unit in a non-combustion operation state through an exhaust collecting pipe.

The invention claimed is:

1. A combined combustion device comprising:

a plurality of combustion units each having a burner and an air supply fan;

an exhaust collecting pipe connecting the plurality of the combustion units to each other;

a check valve provided in each of the combustion units, which opens by rotation of the air supply fan and prevents backflow of combustion exhaust gas from the exhaust collecting pipe into each of the combustion units; and a controller for controlling operations of the plurality of the combustion units, wherein when at least one of the combustion units starts a combustion operation, the controller determines whether each of the combustion units is in a combustion operation state and measures time when each of the combustion units is in a non-combustion operation state, and when one or more of the combustion units among the plurality of the combustion units are in the combustion operation state and the other one or more of the combustion units are continuously maintained in the non-combustion operation state for a predetermined reference stoppage time or longer, the controller rotates the air supply fans in the other one or more of the combustion units for a certain time, every time the predetermined reference stoppage time has passed.

2. The combined combustion device according to claim 1, wherein the check valve has a first valve opening by rotating the air supply fan at a high rotation speed and a second valve opening by rotating the air supply fan at a low rotation speed.

3. The combined combustion device according to claim 1, further comprising a backflow detector for detecting the backflow of the combustion exhaust gas in each of the combustion units, wherein when at least one of the backflow detectors in the other one or more of the combustion units detects the backflow of the combustion exhaust gas, the controller rotates the air supply fans in the combustion unit detected the backflow among the other one or more of the combustion units for a given time even when the combustion unit detected the backflow among the other one or more of the combustion units is maintained in the non-combustion operation state for less than the reference stoppage time.

4. The combined combustion device according to claim 1, further comprising a backflow detector for detecting the backflow of the combustion exhaust gas in each of the combustion units, wherein when the backflow detector detects the backflow of the combustion exhaust gas, the controller reduces the reference stoppage time.

5. The combined combustion device according to claim 4, wherein when the backflow detector detects the backflow of the combustion exhaust gas after the reference stoppage time is reduced, the controller notifies an abnormality.

6. The combined combustion device according to claim 1, wherein the controller includes control units which control operations of each of the combustion units and a connecting control unit which controls operations of the control units wherein the control unit includes a combustion operation control section for controlling a combustion operation of the combustion unit and a fan control section for controlling an operation of the air supply fan, and the connecting control unit includes an operation control section for determining a number of the combustion units requiring to perform the combustion operation with load and giving an instruction of the combustion operation to each of the control units and an intermittent blow operation control section for giving an instruction of intermittent blow operation to the combustion unit in the non-combustion operation state.

7. A combined combustion device comprising:

a plurality of combustion units each having a burner, an air supply fan, and a backflow detector for detecting backflow of combustion exhaust gas;

an exhaust collecting pipe connecting the plurality of the combustion units to each other;

a check valve provided in each of the combustion units, which opens by rotation of the air supply fan and prevents the backflow of the combustion exhaust gas from the exhaust collecting pipe into each of the combustion units; and a controller for controlling operations of the plurality of the combustion units, wherein when one or more of the combustion units among the plurality of the combustion units are in a combustion operation state, the other one or more of the combustions units are continuously maintained in a non-combustion operation state, and at least one of the backflow detectors in the other one or more of the combustion units in the non-combustion operation state detects the backflow of the combustion exhaust gas, the controller rotates the air supply fan in the combustion unit detected the backflow among the other one or more of the combustion units in the non-combustion operation state for a certain time, and when at least one of the backflow detectors in the other one or more of the combustion units in the non-combustion operation state detects the backflow of the combustion exhaust gas even after detection of the backflow and subsequent rotation of the air supply fan are repeated a predetermined number of times, the controller notifies an abnormality.

8. The combined combustion device according to claim 7, wherein the check valve has a first valve opening by rotating the air supply fan at a high rotation speed and a second valve opening by rotating the air supply fan at a low rotation speed.

9. The combined combustion device according to claim 7, wherein the backflow detector includes a CO sensor.

10. The combined combustion device according to claim 7, wherein the controller includes control units which control operations of each of the combustion units and a connecting control unit which controls operations of the control units wherein the control unit includes a combustion operation control section for controlling a combustion operation of the combustion unit and a fan control section for controlling an operation of the air supply fan, and the connecting control unit includes an operation control section for determining a number of the combustion units requiring to perform the combustion operation with load and giving an instruction of the combustion operation to each of the control units and a blow operation control section for giving an instruction of blow operation to the combustion unit in the non-combustion operation state.

11. A combined combustion device comprising:

a plurality of combustion units each have a burner, an air supply fan, and a backflow detector for detecting backflow of combustion exhaust gas;

an exhaust collecting pipe connecting the plurality of the combustion units to each other;

a check valve provided in each of the combustion units, which opens by rotation of the air supply fan and prevents backflow of combustion exhaust gas from the exhaust collecting pipe into each of the combustion units; and a controller for controlling operations of the plurality of the combustion units, wherein when at least one of the combustion units starts a combustion operation, the controller determines whether each of the combustion units is in a combustion operation state and measures time when each of the combustion units is in a non-combustion operation state, when one or more of the combustion units among the plurality of the combustion units are in the combustion operation state and the other one or more of the combustion units are continuously maintained in the non-combustion operation state for a predetermined reference stoppage time or longer, the controller rotates the air supply fans in the other one or more of the combustion units for a certain time, every time the reference stoppage time has passed, and when at least one of the backflow detectors in the other one or more of the combustion units detects the backflow of the combustion exhaust gas after the air supply fans in the other one or more of the combustion units are rotated for the certain time, the controller reduces the reference stoppage time.

* * * * *